United States Patent [19]

Schwartz

[11] Patent Number: 4,691,845

[45] Date of Patent: Sep. 8, 1987

[54] DISPENSING CONTAINER

[75] Inventor: Thomas W. Schwartz, Troy, Wis.

[73] Assignee: Minnesota Mining and Manufacturing Company, Saint Paul, Minn.

[21] Appl. No.: 739,687

[22] Filed: May 31, 1985

[51] Int. Cl.[4] ..... B65D 35/22; B65D 88/54

[52] U.S. Cl. ..... 222/94; 222/95; 222/136; 222/252; 222/276; 222/386

[58] Field of Search ..... 222/137, 136, 325–327, 222/386, 391, 390, 94, 95, 145, 129, 252, 276, 103; 604/191, 228

[56] References Cited

U.S. PATENT DOCUMENTS

| | | | |
|---|---|---|---|
| 3,266,671 | 8/1966 | Gelpey | 222/137 X |
| 3,620,417 | 11/1971 | Simms | 222/136 |
| 3,858,853 | 1/1975 | Rausch et al. | 259/40 |
| 4,029,236 | 6/1977 | Carson, Jr. et al. | 222/135 |
| 4,050,612 | 9/1977 | Stone | 222/135 |
| 4,340,154 | 7/1982 | VanManen | 222/94 |
| 4,471,888 | 9/1984 | Herb et al. | 222/137 |
| 4,493,436 | 1/1985 | Brokaw | 222/137 X |
| 4,566,610 | 1/1986 | Herb | 222/137 |

*Primary Examiner*—Joseph J. Rolla
*Assistant Examiner*—David H. Bollinger
*Attorney, Agent, or Firm*—Donald M. Sell; James A. Smith; William L. Huebsch

[57] ABSTRACT

A dispensing container of the type comprising a tube, a transverse end wall in which is fixed an outwardly projecting nozzle, and a plunger slidably mounted within the tube to dispense a first material within the tube through the nozzle. At least one hose is fixed to the tube, a second material to be dispensed is contained within the hose, and means are provided for dispensing the second material from the hose in proportion to the first material dispensed from the nozzle upon movement of the plunger.

4 Claims, 11 Drawing Figures

DISPENSING CONTAINER

TECHNICAL FIELD

This invention relates to containers from which proportional amounts of two or more separate materials may be dispensed at the same time.

BACKGROUND ART

Many container constructions have been proposed for dispensing separate materials which are not to be mixed until just before or after they are dispensed for various reasons, such as to prevent the materials from solidifying in the container. U.S. Pat. Nos. 3,858,853; 4,029,236; and 4,050,612 are specifically noted as dealing with this problem. The devices described in these patents, however, are either more complex and costly or more difficult to use than might otherwise be desired.

DISCLOSURE OF INVENTION

The present invention affords a simple, effective dispenser for two or more materials that is inexpensive and may be adapted for use in the ubiquitous caulking gun so that it can be easily used by home craftsmen.

According to the present invention there is provided a dispensing container of the type comprising a tube having first and second ends, a transverse end wall fixed at the second end of the tube, a nozzle having one end attached to the end wall and projecting from the side of the end wall opposite the tube, and a plunger slidably mounted within the tube for movement from a first position adjacent the first end of the tube to a second position adjacent the end wall to dispense a first material within the tube through the nozzle. The improved container also includes at least one hose, which hose is fixed to the tube and extends from adjacent the first end of the tube past the end wall. A material to be dispensed separately from the material in the tube is contained within the hose, and means are provided for affording displacement of the material from the hose in an amount proportional to the amount of material dispensed from the tube upon movement of the plunger toward its second position.

The hose can be affixed to the outside of the tube, but preferably is contained within the tube and extends through the end wall.

The means for affording displacement of the second material from the hose can be in the form of a magnetized piston in the hose which is magnetically coupled to a metal portion of the plunger or a metal portion of drive member which moves the plunger or can be a projection from the plunger; but preferably comprises a flexible wall for the hose which is progressively flattened against the tube via means on the container or a dispenser in which the container is used as the plunger is moved toward the second end of the tube. For a hose on the outer surface of the tube, such flattening would be most easily accomplished by a portion of the dispenser that moves axially along the outside surface of the tube. In the most preferred embodiment of the dispensing container that is adapted to be used in a conventional caulking gun, the hose is within the tube and extends through the end wall, and such flattening is done by a side surface of the plunger as the plunger is moved toward the end wall.

BRIEF DESCRIPTION OF DRAWING

The present invention will be more thoroughly described with reference to the accompanying drawing wherein like numbers refer to like parts in the several views, and wherein.

DESCRIPTION OF THE PREFERRED EMBODIMENTS

Figure 1:
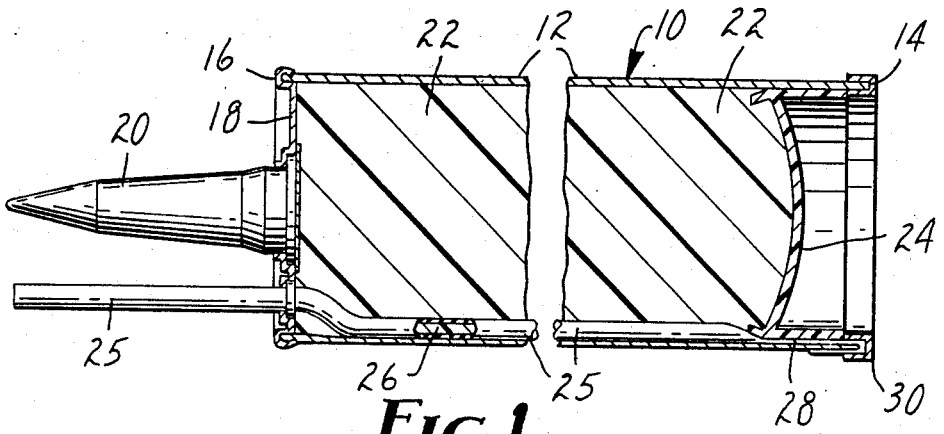
FIGS. 1 and 2 are fragmentary sectional side views of a first embodiment of a dispensing container according to the present invention which views illustrate two positions of a plunger in the container.
Figure 2:
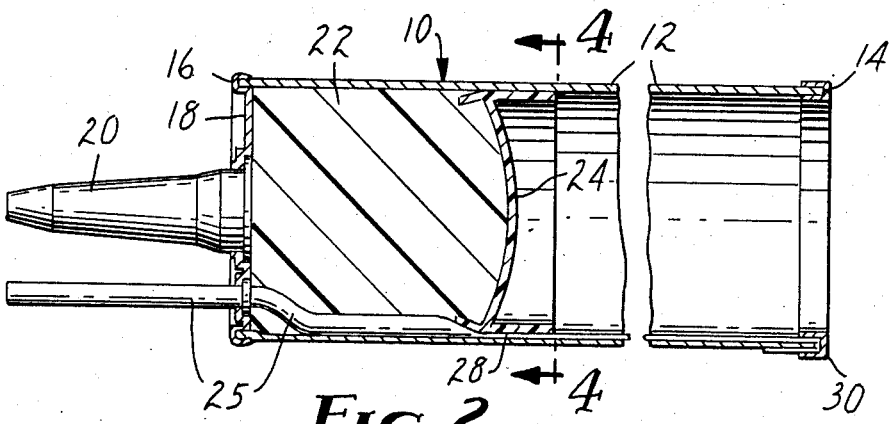
Figure 3:
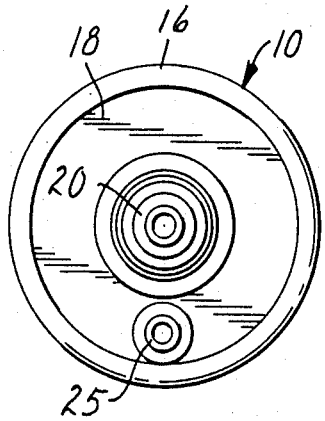
FIG. 3 is a front end view of the dispensing container of FIG. 1.
Figure 4:
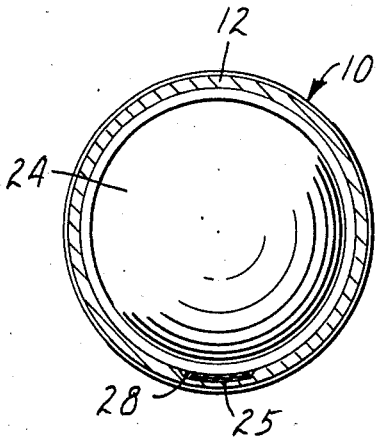
FIG. 4 is a sectional view taken approximately along line 4—4 of FIG. 2.

Referring now to the drawing there is shown in FIGS. 1 through 4 a first embodiment of a dispensing container or cartridge according to the present invention generally designated by the reference numeral 10.

The dispensing container 10 has a shape and structure adapted to be received and used in a conventional caulking gun, which structure, like that of a conventional caulking cartridge, comprises a cylindrical tube 12 having first and second ends 14 and 16, a transverse circular end wall 18 fixed at the second end 16 of the tube 12, a hollow conical nozzle 20 having its base end attached in a central opening through the circular end wall 18 and its opposite apex end projecting from the side of the end wall 18 opposite the tube 12. A first material 22 to be dispensed is contained within the tube, and a plunger 24 is slidably mounted within the tube 12 for movement from a first position (FIG. 1) adjacent the first end 14 of the tube 12 to a second position adjacent the end wall 18 to dispense the first material 22 through the nozzle 20 after a closed tip on the nozzle 20 has been cut away. Unlike conventional cartridges, however, the container 10 further includes a flexible hose 25 fixed within the tube 12 and extending through the end wall 18. A second material 26 to be dispensed is contained within the hose 25. A side surface portion 28 of the plunger will slide along and flatten the wall of the hose 25 against the inner surface of the tube 12 to dispense the second material 26 after a closed end on the hose 25 has been cut away, thus providing means for displacing the second material 26 from the hose 25 simultaneously with and at a rate proportionate to the rate of dispensing of the first material 22 upon movement of the plunger 24 toward its second position.

The hose 25 is of a flexible material (e.g., preferably a polymeric material such as nylon, teflon, polyester or polyethylene which is selected to restrict reaction with the materials 22 and 26 being dispensed. One end of the hose 25 is retained in a flattened condition against the inner surface of the tube 12 by a flange 30 at the first end 14 of the tube 12. The hose 25 extends axially parallel along and in contact with the inner surface of the tube 12 to a position closely adjacent the end wall 18 where it bends inwardly of the tube 12 and then extends through the end wall 18 (to which it is sealed) and away from the end wall 18 in a direction axially parallel to the nozzle 20.

FIGS. 5 through 11 show four alternate embodiments of dispensing containers according to the present invention, generally designated respectively by the reference numerals 50, 60, 80 and 100.

Figure 5:
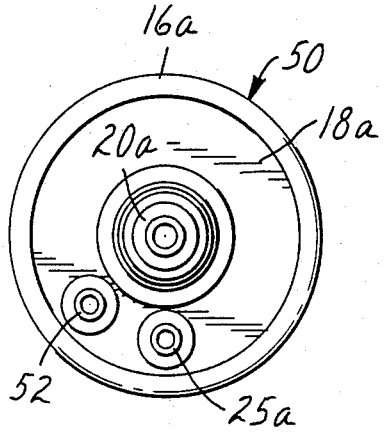
FIG. 5 is a front end view of a second embodiment of a dispensing container according to the present invention.
Figure 6:
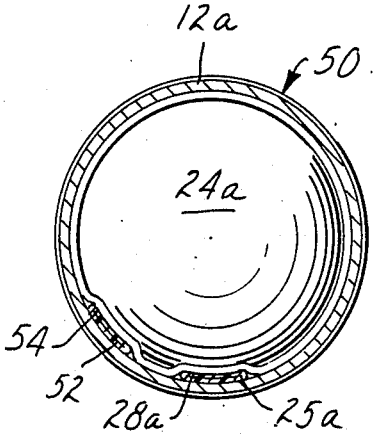
FIG. 6 is a sectional view of the container of FIG. 5 taken along a line comparable to the section line 4—4 shown in FIG. 2.

The dispensing container 50, shown in FIGS. 5 and 6, has much of the same structure as the container 10, and the parts thereof that are essentially the same as the parts of the container 10 have been given the same reference numerals with the addition of the suffix "a". These parts include a tube **12*a* with a first end (not shown) and a second end 16*a* a nozzle 20*a* projection from a tranverse end wall 18*a* at its second end 16*a*, a hose 25*a* within the tube and extending from its second end through the end wall 18*a*, and a plunger 24*a* slidably mounted within the tube 12*a* for dispensing the material through the nozzle 20*a* which plunger 24*a* has a side surface portion 28*a* for collapsing the hose 25*a* against the inner surface of the tube 12*a* to simultaneously and proportionally dispensing a second material from the hose 25*a*. In addition to this structure, the container 50 also includes a second hose 52 similar to its first hose 25*a* and the plunger 24*a* has a second side surface portion 54 aligned to collapse the hose 52 against the inner surface of the tube 12*a* so that three materials can be proportionately dispensed. In the dispensing container 50 the side surface portions 28*a* and 54 are flatened which optionally may be done to accommodate the thicknesses of the flatened hoses 25*a* and 52**. Alternatively more than two hoses could also be used, and the hoses could be of different sizes to provide desired ratios of materials.

Figure 7:
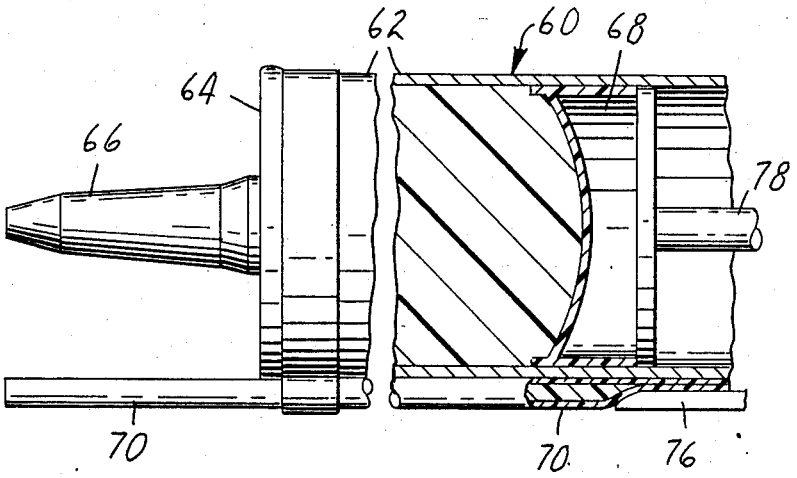
FIG. 7 is a fragmentary side view, partially in section, of a third embodiment of a dispensing container according to the present invention.

The dispensing container 60 shown in FIG. 7 also has a structure similar to the structure of the container 10 in that it comprises a tube 62 with an end wall 64 from which projects a nozzle 66, and a plunger 68 slidably mounted within the tube 62 to dispense material within the tube 62 between the end wall 64 and plunger 68 through the nozzle 66. The container 60 illustrated has a single hose 70 (but could have a plurality of such hoses 70) fixed against its outer surface axially parallel to the tube 62 and extending along the tube 62 from a first end of the tube 62 opposite the end wall 64 and past the end wall 64. The walls of the hose 70 are flexible and a dispensing gun in which the container 60 is adapted to be used has a portion 76 adapted to move along and flatten the hose 70 against the outer surface of the tube 62 as a drive member 78 in the dispensing gun moves the plunger 68 to provide means for displacing the second material from the hose 70 simultaneously with and at a rate proportional to the rate of dispensing of the first material upon movement of the plunger 68 toward the end wall 64.

Figure 8:
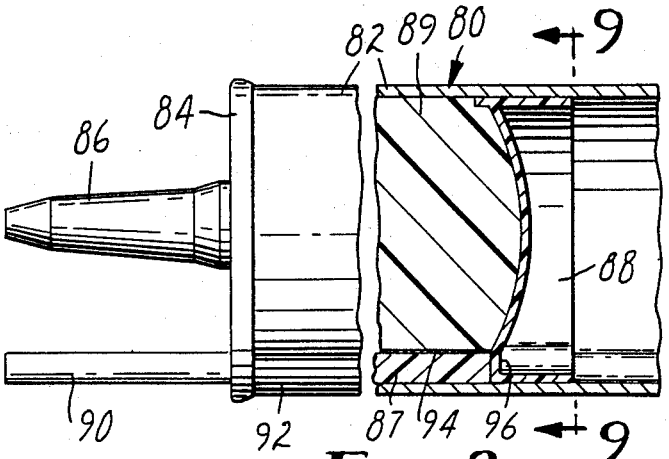
FIG. 8 is a fragmentary side view, partially in section, of a fourth embodiment of a dispensing container according to the present invention.
Figure 9:
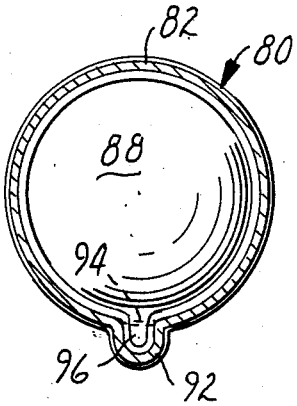
FIG. 9 is a sectional view taken approximately along line 9—9 of FIG. 8.

The dispensing container 80 shown in FIGS. 8 and 9 also has a structure similar to the structure of the container 10 in that it comprises a tube 82 with an end wall 84 from which projects a nozzle 86, and a plunger 88 slidably mounted within the tube 82 to dispense a first material 89 within the tube 82 between the end wall 84 and plunger 88 through the nozzle 86. The container 80 illustrated has a single hose 90 containing a second material 87 (but could have a plurality of such hoses 90) defined along its outer surface axially parallel to the tube 82 and extending along the tube 82 from a first end of the tube 62 opposite the end wall 64 and past the end wall 84. The hose 90 is defined by a tubular portion extending beyond the end wall 84, by an arcuate radially outwardly projecting longitudinally extending portion 92 of the wall of the tube 82, and by a rupturable film 94 adhered across the open side of the arcuate wall portion 92 to separate the second material 87 in the hose 90 from the first material 89 in the tube 82. The plunger 88 has a radial protrusion 96 shaped to correspond with and move along the inner surface of the tube portion 92, which protrusion 96 will rupture the film 94 as it moves and provides means for displacing the second material form the hose 90 simultaneously with and at a rate proportional to the rate of dispensing of the first material upon movement of the plunger 88 toward the end wall 84.

Figure 10:
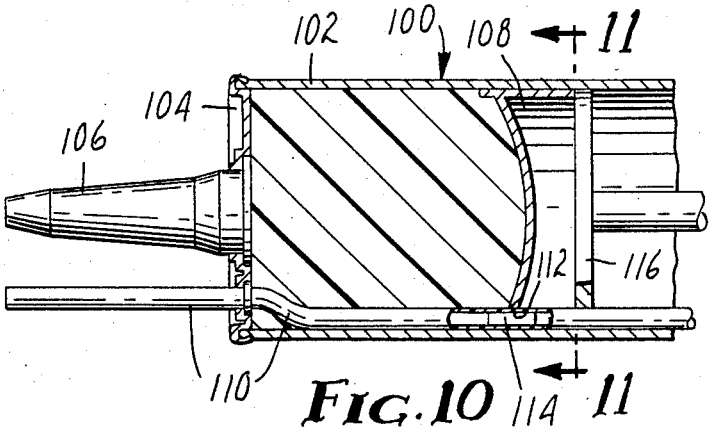
FIG. 10 is a fragmentary sectioned side view of a fifth embodiment of a dispensing container according to the present invention.
Figure 11:
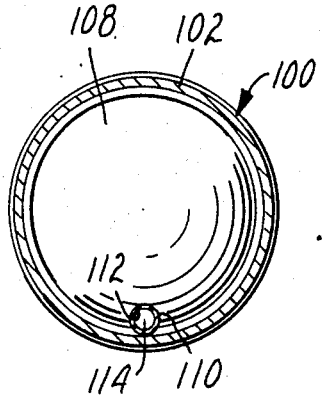
FIG. 11 is a sectional view taken approximately along line 11—11 of FIG. 10.

The dispensing container 100 shown in FIGS. 10 and 11 also has a structure similar to the structure of the container 10 in that it comprises a tube 102 with an end wall 104 from which projects a nozzle 106, and a plunger 108 slidably mounted within the tube 102 to dispense material within the tube 102 between the end wall 104 and plunger 108 through the nozzle 106. The container 100 illustrated has a single hose 110 containing a second material (but could have a plurality of such hoses 110 containing a plurality of materials) fixed against its inner surface axially parallel to the tube 102 and extending along the tube 102 from a first end of the tube 102 opposite the end wall 104 through and past the end wall 104. The hose 110 extends through a clearance opening 112 in the plunger 108, and contains a magnetized slug 114 slidably mounted therein. The slug 114 will magnetically couple to the plunger 108 which is made of a ferric metal, and can similarly couple to a ferous metal drive member 116 in a dispensing gun in which the container 110 is mounted so that the slug 114 will move along the hose 110 and provide means for displacing the second material from the hose 110 simultaneously with and at a rate proportional to the rate of dispensing of the first material upon movement of the plunger 108 toward the end wall 104.

Those skilled in the art will appreciate that many variations and combinations of the parts of the illustrated embodiments could be made without departing from the spirit of the present invention. Thus the scope of the present invention should not be limited to the structures described, but only to structures falling within the limits recited in the dependent claims and their equivalents.

I claim:

1. In a dispensing container of the type comprising a tube having an axis and first and second ends, a transverse end wall fixed at the second end of said tube, a nozzle having one end attached in said end wall and projecting from the side of said end wall opposite said tube, a first material to be dispensed contained within said tube, and a plunger slidably mounted within said tube for movement from a first position adjacent the first end of said tube to a second position adjacent said end wall to dispense said first material through said nozzle, the improvement wherein:

said container further includes at least one hose of a uniform cross sectional area along its length, said hose being fixed to and positioned within said tube and extending from adjacent said first end past and through said end wall; a second material to be dispensed contained within said hose; and means for affording displacement of said second material from said hose in an amount proportional to the amount of said first material displaced from said tube upon movement of said plunger toward said second position comprising said plunger being of a ferric metal, and said container including a magnetized follower within said hose adapted to be advanced along said hose toward said end wall by magnetic coupling to said plunger upon movement of said plunger toward the second end of said tube.

2. In a dispensing container of the type comprising a tube having an axis and first and second ends, a transverse end wall fixed at the second end of said tube, a nozzle having one end attached in said end wall and projecting from the side of said end wall opposite end tube, a first material to be dispensed contained within said tube, and a plunger slidably mounted within said tube for movement from a first position adjacent the first end of said tube to a second position adjacent said end wall to dispense said first material through said nozzle, the improvement wherein said container further includes at least one hose of a uniform cross sectional area along its length, said hose being fixed along and in contact with the outer surface of said tube, extending from adjacent said first end past and through said end wall; and having a flexible wall; a second material to be dispensed contained within said hose; and means for affording displacement of said second material from said hose in an amount proportional to the amount of said first material displaced from said tube upon movement of said plunger toward said second position by flattening of the wall of said hose against said tube.

3. In a dispensing container of the type comprising a tube having an axis and first and second ends, a transverse end wall fixed at the second end of said tube, a nozzle having one end attached in said end wall and projecting from the side of said end wall opposite said tube, and a plunger slidably mounted within said tube for movement from a first position adjacent the first end of said tube to a second position adjacent said end wall, the improvement wherein:

said container further includes at least one hose of a uniform cross sectional area along its length, said hose being fixed to and positioned within said tube and extending from adjacent said first end past and through said end wall; and means for affording displacement of a material from said hose in an amount proportional to the amount of a materal displaced from the tube through the nozzle upon movement of said plunger towards its second position comprising a magnetized follower within said hose adapted to be advanced along said hose toward said end wall by magnetic attraction to metal moving with said plunger toward the second end of said tube.

4. In a dispensing container of the type comprising a tube having an axis and first and second ends, a transverse end wall fixed at the second end of said tube, a nozzle having one end attached in said end wall and projecting from the side of said end wall opposite said tube, and a plunger slidably mounted within said tube for movement from a first position adjacent the first end of said tube to a second position adjacent said end wall, the improvement wherein:

said container further includes at least one hose of a uniform cross sectional area along its length, said hose is fixed along and in contact with the outer surface of said tube, extends from adjacent said first end past said end wall and has a flexible wall; and said means for affording displacment of a material from said hose in an amount proportional to the amount of a material displaced from the tube through the nozzle upon movement of said plunger towards its second position by flattening of the wall of said hose against said tube.

* * * * *